US006033026A

United States Patent [19]

Tseng

[11] Patent Number: 6,033,026

[45] Date of Patent: Mar. 7, 2000

[54] CHAIR FRAME ASSEMBLY WITH ADJUSTABLE WIDTH

[75] Inventor: Chuen-Jong Tseng, Chiayi Hsien, Taiwan

[73] Assignee: Shin Yen Enterprise Co., Ltd., Taiwan

[21] Appl. No.: 09/311,765

[22] Filed: May 13, 1999

[51] Int. Cl.[7] ..... A47C 7/02

[52] U.S. Cl. ..... 297/452.4; 297/449.1

[58] Field of Search ..... 297/452.4, 42, 297/44, 449.1; 403/109.1

[56] References Cited

U.S. PATENT DOCUMENTS

| | | | |
|---|---|---|---|
| 1,400,717 | 12/1921 | Benson et al. | 297/452.4 |
| 1,945,113 | 1/1934 | Kloboucnik | 297/452.4 |
| 3,759,572 | 9/1973 | Koepke | 297/452.4 |
| 4,684,149 | 8/1987 | Meyer | 297/42 |

*Primary Examiner*—Anthony D. Barfield

*Attorney, Agent, or Firm*—Ladas & Parry

[57] ABSTRACT

A chair frame assembly includes first and second lateral frames formed with aligned first and second mounting holes, and linking units extending between the lateral frames. Each of the linking units includes a tubular positioning sleeve, a connecting rod, a linking rod, and first and second screw bolts. The positioning sleeve is mounted securely on the first lateral frame, and has an axis aligned with a respective one of the first mounting holes. The connecting rod is mounted non-rotatably on the positioning sleeve, and has a first section formed with an internally threaded fastening hole, and an externally threaded second section. The first screw bolt extends through the respective one of the first mounting holes, and engages threadedly the fastening hole. The linking rod has a first end which is formed with an internally threaded first engaging hole that engages threadedly the second section of the connecting rod, and a second end formed with an internally threaded second engaging hole. The second screw bolt extends rotatably through the corresponding one of the second mounting holes, and engages threadedly the second engaging hole of the linking rod.

4 Claims, 3 Drawing Sheets

CHAIR FRAME ASSEMBLY WITH ADJUSTABLE WIDTH

BACKGROUND OF THE INVENTION

1. Field of the Invention

This invention relates to a chair frame assembly, more particularly to a chair frame assembly which can be disassembled and which permits adjustment of the width thereof.

2. Description of the Related Art

Chair frames that can be disassembled are known in the art. However, the conventional chair frames generally lack facilities for adjusting the width thereof so as to adjust the space of the seat provided thereby. It is desirable to provide a chair frame that can be disassembled and that permits adjustment of the width thereof.

SUMMARY OF THE INVENTION

Therefore, the object of the present invention is to provide a chair frame assembly that can be disassembled and that permits adjustment of the width thereof.

Accordingly, the chair frame assembly of the present invention includes a first lateral frame formed with a plurality of first mounting holes, a second lateral frame formed with a plurality of second mounting holes aligned respectively with the first mounting holes, and a plurality of linking units extending between the first and second lateral frames. Each of the linking units includes a tubular positioning sleeve, a connecting rod, a first screw bolt, a linking rod, and a second screw bolt. The positioning sleeve is mounted securely on the first lateral frame, and has an open first end disposed adjacent to a respective one of the first mounting holes, an open second end distal to the first lateral frame, and an axis aligned with an axis of the respective one of the first mounting holes. The connecting rod extends into and is mounted nonrotatably on the positioning sleeve. The connecting rod has a first section which is proximate to the first lateral frame and which is formed with an internally threaded fastening hole aligned with the respective one of the first mounting holes, and an externally threaded second section distal to the first lateral frame. The first screw bolt extends through the respective one of the first mounting holes and into the positioning sleeve, and engages threadedly the fastening hole in the first section of the connecting rod for fastening the connecting rod to the first lateral frame. The linking rod has a first end which is extendible into the positioning sleeve and which is formed with an internally threaded first engaging hole that engages threadedly the second section of the connecting rod, and a second end which extends to the second lateral frame and which is formed with an internally threaded second engaging hole aligned with a corresponding one of the second mounting holes. The second screw bolt extends rotatably through the corresponding one of the second mounting holes in the second lateral frame, and engages threadedly the second engaging hole of the linking rod for mounting the second end of the linking rod rotatably on the second lateral frame. Axial rotation of the linking rod results in linear movement of the linking rod with respect to the connecting rod so as to permit adjustment of a distance between the first and second lateral frames.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
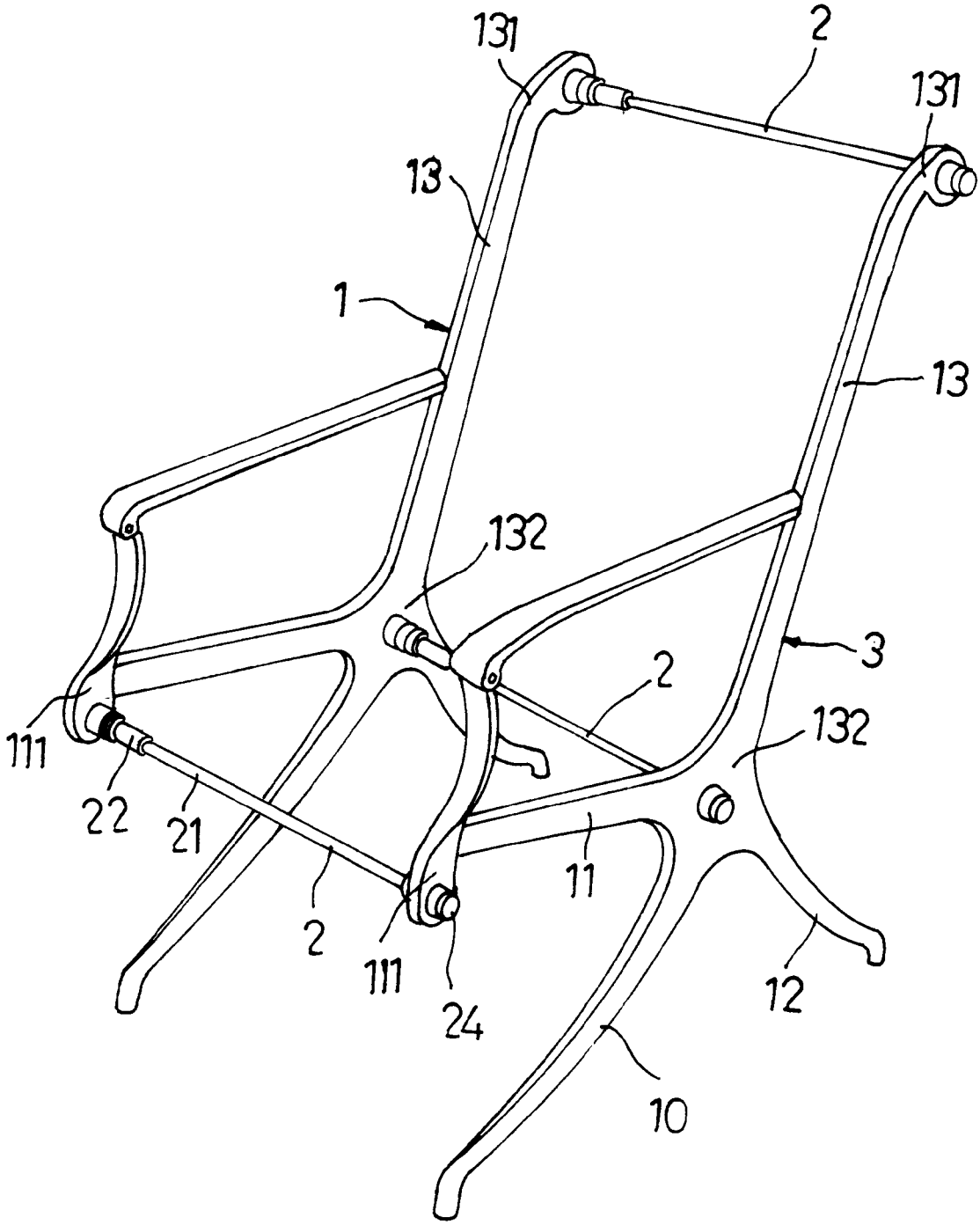
FIG. 1 is a perspective view of a preferred embodiment of the chair frame assembly of the present invention.
Figure 2:
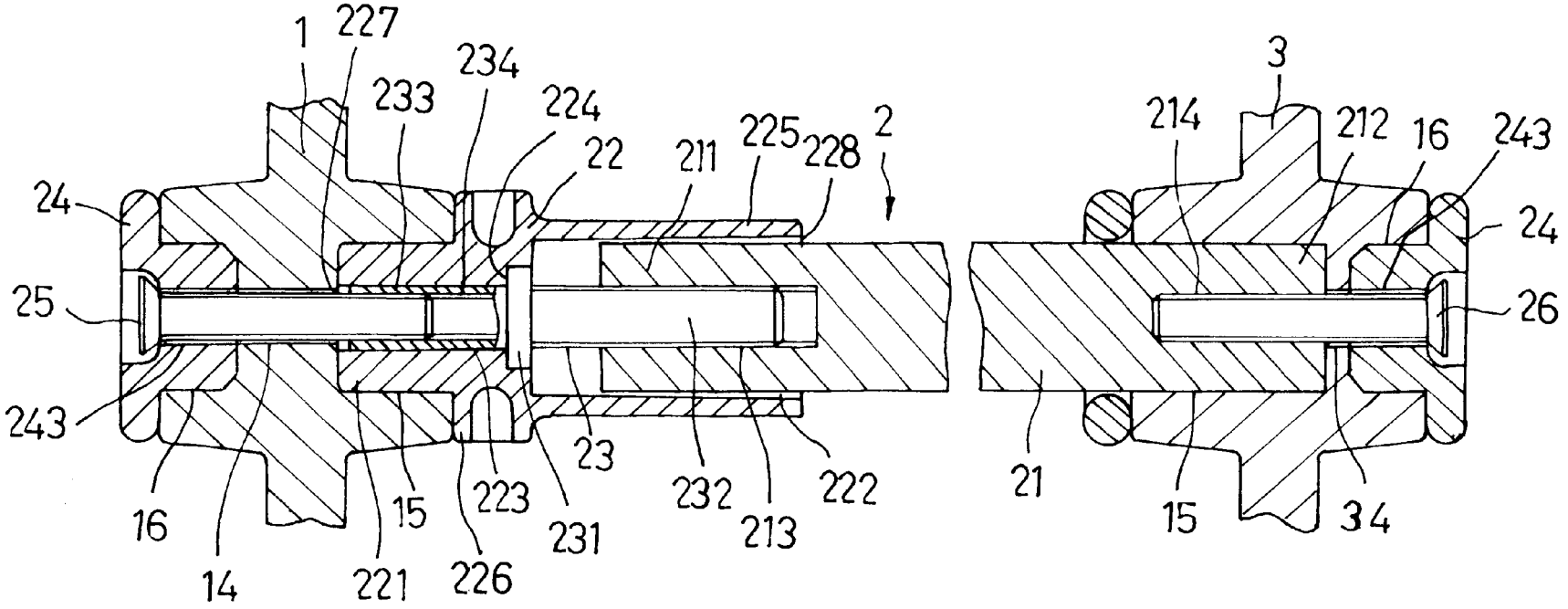
FIG. 2 is a fragmentary sectional view illustrating a linking unit of the chair frame assembly of the preferred embodiment.

Referring to FIGS. 1 and 2, the preferred embodiment of the chair frame assembly of the present invention is shown to include a first lateral frame 1, a second lateral frame 3, and three linking units 2 extending between the first and second lateral frames 1, 3.

Each of the first and second lateral frames 1, 3 extends uprightly, and includes a back part 13 with a top end 131 and a bottom end 132, a seat part 11 that extends forwardly from the bottom end 132 of the back part 13 and that has a front end 111, a front leg 10 which extends forwardly and downwardly from the bottom end 132 of the back part 13, and a rear leg 12 which extends rearwardly and downwardly from the bottom end 132 of the back part 13. The first lateral frame 1 is formed with horizontally extending first mounting holes 14 at the top and bottom ends 131, 132 of the back parts 13 and at the front end 111 of the seat part 11, respectively. The second lateral frame 3 is formed with horizontally extending second mounting holes 34 that are aligned with the first mounting holes 14, respectively. Each of the first and second lateral frames 1, 3 has an inner side that faces the other one of the lateral frames 1, 3 and that is formed with circular inner recesses 15 around the mounting holes 14, 34, respectively, and an outer side that is opposite to the other one of the lateral frames 1, 3 and that is formed with circular outer recesses 16 around the mounting holes 14, 34, respectively.

Figure 3:
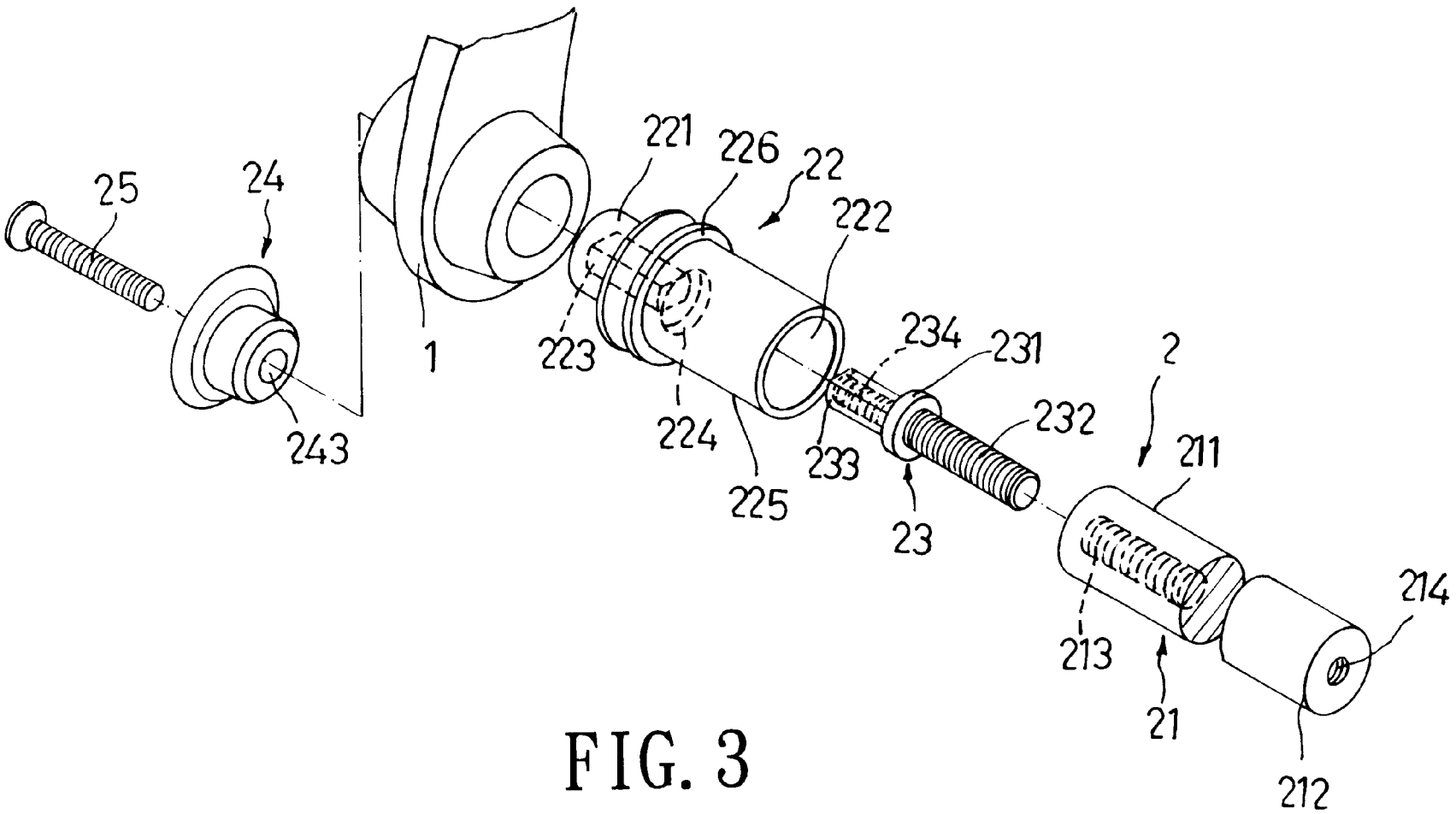
FIG. 3 is a fragmentary exploded perspective view illustrating the linking unit of the chair frame assembly of the preferred embodiment.

Referring to FIGS. 2 and 3, each of the linking units 2 extends between an aligned pair of the first and second mounting holes 14, 34 in the first and second lateral frames 1, 3, and is shown to include a tubular positioning sleeve 22, a connecting rod 23, a linking rod 21, first and second screw bolts 25, 26, and a pair of plug members 24.

The positioning sleeve 22 has a first section 221 formed with a positioning hole 223 with a non-circular cross-section, a second section 225 confining a slide groove 222 therein, and an enlarged intermediate section 226 between the first and second sections 221, 225. A retaining hole 231 is formed between the positioning hole 223 and the slide groove 222, and is communicated with the same. The retaining hole 231 has a cross-section larger than that of the positioning hole 223 such that a retaining shoulder 224 is formed between the retaining hole 231 and the positioning hole 223. The positioning sleeve 22 has an open first end 227 formed at the first section 221 and proximate to the first mounting hole 14, and an open second end 228 formed at the second section 225 and distal to the first mounting hole 14. The first section 221 of the positioning sleeve 22 is inserted fittingly and securely into the respective inner recess 15 so as to be mounted securely on the first lateral frame 1, and has an axis aligned with axes of the aligned pair of the first and second mounting holes 14, 34.

The connecting rod 23 has a first section 233 formed with an internally threaded fastening hole 234, an externally threaded second section 232, and an annular retaining flange 231 formed between the first and second sections 233, 232.

The first section 233 of the connecting rod 23 has a cross-section corresponding to that of the positioning hole 223 in the positioning sleeve 22, and extends into the positioning hole 223 for coupling non-rotatably to the positioning sleeve 22. The retaining flange 231 abuts against the retaining shoulder 224 so as to be retained in the retaining hole 231. The externally threaded second section 232 is disposed within the slide groove 222 in the second section 225 of the positioning sleeve 22.

Each of the plug members 24 is received fittingly in a respective one of the outer recesses 16, and is formed with a through hole 243 aligned with the respective one of the first and second mounting holes 14, 34.

The first screw bolt 25 extends through the through hole 243, the respective first mounting hole 14 and into the first section 221 of the positioning sleeve 22 for engaging threadedly the fastening hole 234 in the first section 233 of the connecting rod 23, thereby fastening the connecting rod 23 to the first lateral frame 1.

The linking rod 21 has a first end 211 formed with a longitudinally extending and internally threaded first engaging hole 213, and an opposite second end 212 formed with a longitudinally extending and internally threaded second engaging hole 214 that is aligned with the respective one of the second mounting holes 34 in the second lateral frame 3. The first end 211 of the linking rod 21 engages threadedly the externally threaded second section 232 of the connecting rod 23, and is extendible into the slide groove 222 of the positioning sleeve 22. The second end 212 of the linking rod 21 extends into the respective one of the inner recesses 15 in the second lateral frame 3 around the respective second mounting hole 34.

The second screw bolt 26 extends rotatably through the through hole 243 in the respective plug member 24 that is mounted in the second lateral frame 3 and through the respective second mounting hole 34 in the second lateral frame 3, and engages threadedly the second engaging hole 214 of the linking rod 21.

To adjust the distance between the first and second lateral frames 1, 3, that is, the width of the chair frame assembly, the linking rod 21 of each of the linking units 2 is rotated axially relative to the positioning sleeve 22. Since the connecting rod 23 is fastened to the first lateral frame 1 and is coupled non-rotatably to the positioning sleeve 22, and since the positioning sleeve 22 is secured to the first lateral frame 1, the connecting rod 23 is prevented from both axial rotation and longitudinal displacement. Thus, due to the threaded engagement between the connecting rod 23 and the linking rod 21, the linking rod 21 moves linearly with respect to the second section 232 of the connecting rod 23 toward or away from the first lateral frame 1 to adjust the distance between the first and second lateral frames 1, 3. In addition, by means of the adjustment operation, the first and second lateral frames 1, 3 can be kept parallel to each other.

To disassemble the chair frame assembly of the present embodiment, the first and second screw bolts 25, 26 are simply unthreaded from the first section 233 of the connecting rod 23 and from the second end 212 of the linking rod 21, respectively. Thereafter, the positioning sleeve 22, the connecting rod 23, the linking rod 21, and the plug members 24 can be easily detached from the first and second lateral frames 1, 3.

It has thus been shown that the chair frame assembly of the present invention can be easily disassembled to result in added convenience during packaging and transport, and permits adjustment of the width thereof by simply operating the linking rods 21.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A chair frame assembly comprising:

a first lateral frame formed with a plurality of first mounting holes;

a second lateral frame formed with a plurality of second mounting holes aligned respectively with said first mounting holes; and a plurality of linking units extending between said first and second lateral frames, each of said linking units including;

a tubular positioning sleeve mounted securely on said first lateral frame, said positioning sleeve having an open first end disposed adjacent to a respective one of said first mounting holes, an open second end distal to said first lateral frame, and an axis aligned with an axis of the respective one of said first mounting holes;

a connecting rod extending into and mounted non-rotatably on said positioning sleeve, said connecting rod having a first section which is proximate to said first lateral frame and which is formed with an internally threaded fastening hole aligned with the respective one of said first mounting holes, and an externally threaded second section distal to said first lateral frame;

a first screw bolt extending through the respective one of said first mounting holes and into said positioning sleeve, and engaging threadedly said internally threaded fastening hole in said first section of said connection rod for fastening said connecting rod to said first lateral frame;

a linking rod having a first end which extends into said positioning sleeve and which is formed with an internally threaded first engaging hole that engages threadedly said second section of said connection rod, and a second end which extends to said second lateral frame and which is formed with an internally threaded second engaging hole aligned with a corresponding one of said second mounting holes; and a second screw bolt extending rotatably through the corresponding one of said second mounting holes in said second lateral frame and engaging threadedly said second engaging hole of said linking rod for mounting said second end of said linking rod rotatably on said second lateral frame;

axial rotation of said linking rod resulting in linear movement of said linking rod with respect to said connecting rod so as to permit adjustment of a distance between said first and second lateral frames.

2. The chair frame assembly according to claim 1, wherein said first lateral frame is formed with a recess around the respective one of said first mounting holes said positioning sleeve having a first section which extends fittingly into said recess.

3. The chair frame assembly according to claim 2, wherein said first section of said positioning sleeve is formed with a positioning hole that has a non-circular cross-section, said first section of said connecting rod having a cross-section that corresponds to that of said positioning hole, said first section of said connecting rod extending into said positioning hole for mounting non-rotatably on said positioning sleeve.

4. The chair frame assembly according to claim 1, wherein each of said first and second lateral frames includes a vertical back part with top and bottom ends, a horizontal seat part which extends forwardly from said bottom end of said back part and which has a front end, a front leg which extends forwardly and downwardly from said bottom end of said back part, and a rear leg which extends rearwardly and downwardly from said bottom end of said back part, a first one of said linking units extending between said top ends of said back parts of said first and second lateral frames, a second one of said linking units extending between said bottom ends of said back parts of said first and second lateral frames, a third one of said linking units extending between said front ends of said seat parts of said first and second lateral frames.

* * * * *